US007047919B2

(12) United States Patent
Morin et al.

(10) Patent No.: US 7,047,919 B2
(45) Date of Patent: May 23, 2006

(54) MADE TO AN ELECTROMECHANICAL VALVE ACTUATOR OF AN INTERNAL COMBUSTION ENGINE

(75) Inventors: Cédric Morin, Meudon (FR); Emmanuel Sedda, Conflans Sainte Honorine (FR); Christophe Fageon, Montrouge (FR); Christophe Baldi, Paris (FR)

(73) Assignee: Peugeot Citroen Automobiles SA, Velizy Villacoublay (FR)

( * ) Notice: Subject to any disclaimer, the term of this patent is extended or adjusted under 35 U.S.C. 154(b) by 0 days.

(21) Appl. No.: 11/046,254

(22) Filed: Jan. 27, 2005

(65) Prior Publication Data

US 2005/0166873 A1 Aug. 4, 2005

(30) Foreign Application Priority Data

Feb. 3, 2004 (FR) ..... 04 50202

(51) Int. Cl.
*F01L 9/04* (2006.01)

(52) U.S. Cl. ..... 123/90.11; 251/129.1; 251/129.15; 251/129.16

(58) Field of Classification Search ..... 123/90.11; 251/129.1, 129.15, 129.16
See application file for complete search history.

(56) References Cited

U.S. PATENT DOCUMENTS 6,334,413 B1 * 1/2002 Hattori et al. ..... 123/90.11
2003/0080306 A1 5/2003 Keiji et al.

FOREIGN PATENT DOCUMENTS

EP 1 010 866 A 6/2000
EP 1 174 595 A 1/2002

* cited by examiner

*Primary Examiner*—Thomas Denion
*Assistant Examiner*—Zelalem Eshete
(74) *Attorney, Agent, or Firm*—Fulbright & Jaworski LLP

(57) ABSTRACT

The invention concerns a valve operating device for an internal combustion engine, comprising a means connected to the valve and able to be displaced on a course by which, at one end of this course, the valve is in the closed position and at the other end of the course this valve is in the open position. The displacement command is performed by means of a first and a second electromagnet and spring means such that the means is near to a first electromagnet for the closed position of the valve and near to the second electromagnet for the open position of the valve.

The first electromagnet is of the polarized type with a permanent magnet permitting the means to be held in the position corresponding to the closed position of the valve in the absence of current in the winding of this first electromagnet. The second electromagnet is such that this position is maintained for a non-zero current in the winding of this second electromagnet.

9 Claims, 1 Drawing Sheet

MADE TO AN ELECTROMECHANICAL VALVE ACTUATOR OF AN INTERNAL COMBUSTION ENGINE

This application claims priority from FR 2004/50202 filed Feb. 3, 2004 which is herein incorporated by reference in its entirety.

The invention relates to a control device of the electromechanical type for the opening and closing of intake and/or exhaust valves for a heat engine, particularly an internal combustion engine.

In an internal combustion engine the valves are opened or closed at precise moments in their cycle of operation. In the commonest engine the opening and closing control is performed in a mechanical manner according to the position of the crankshaft. In recent years electromechanical controls for valves have been developed which offer the advantage of simplifying the manufacture of the engine and allowing the duration and the time of the opening and closing of valves to be chosen at will in order to optimize the performance of the engine.

Some of such electromechanical valve control devices generally comprise a magnetic plate or plate cooperating with two electromagnets and two springs.

For this purpose the plate is generally integral with the end of a rod whose other end cooperates with the stem of the valve. The rod can also be integral with the valve stem. One of the electromagnets is designed to draw the pallet to such a position that the valve will be in the closed position. In this position one spring is compressed and the other relaxed, the compressed spring being then used to push the pallet back toward the other position, the one in which the valve is in the open position. The command from the closed position toward the open position is performed by cutting off the power supply to the first electromagnet and by further feeding it to the second electromagnet. In the open position the first spring is relaxed and the second spring is compressed. This second spring pushes the pallet, when commanded, from the open position toward the closed position.

To limit the current consumption of the valve actuator, one or the other of the electromagnets is of the polarized type, that is, a permanent magnet is provided in the magnetic circuit of one and/or the other of the electromagnets. In this case the valve is held in an open position and/or closed position not requiring any current.

SUMMARY AND OBJECT OF THE PRESENT INVENTION

The invention aims to improve the reliability of operation of such a valve control device. It also has the purpose of increasing the ways of controlling the valve actuator.

The valve operator according to the invention is characterized in that the electromagnet that is to command the closing of the valve is of the polarized type, and is such that the valve is held in the closed position by the sole effect of the magnet (or magnets) of the magnetic circuit without feeding current to the corresponding coil, and in that the electromagnet that is to control the opening is such that it requires current to feed the corresponding coil to hold the valve in the fully open position.

This being the case, in the event of failure of the coil of the opening electromagnet, the plate, by the action of the spring associated with the opening position, assumes a position between the two electromagnets and the valve can be closed by the closing control electromagnet.

Thus, in case of a breakdown of the winding of the opening electromagnet, the motor can be stopped with the valve closed. It is known that a motor turned off with its valves closed provides braking or locking action when the vehicle is stopped. Furthermore, the motor can continue to idle, inefficiently since the valve cannot stay in the fully open position.

In case of a breakdown of the winding of the closing electromagnet it is likewise possible to close the valve by acting on the current of the coil of the opening electromagnet so that the plate is pushed back toward the polarized closing electromagnet. In this hypothesis of a breakdown the valve also remains closed, which is also favorable to safety.

In both these cases of breakdown, to shift the valve toward the closing position it is necessary to provide a means of breakdown detection, as for example a means for detecting the intensity of the current passing through each of the windings of the electromagnets.

In one embodiment, the opening electromagnet is of the non-polarized type, that is, it does not have a permanent magnet. As a variant, this opening electromagnet is of the polarized type, that is, it has a permanent magnet; however, in this case the permanent magnet must be such that, when the current in the corresponding winding is zero, it does not allow the plate to be locked in the fully open position no matter what the temperature is, The windings of the two electromagnets can be in series or in parallel, or independent of one another. When the windings are in parallel, if one of the windings is in open circuit (due to an accident, it does not disturb the operation of the other winding. Connecting the windings in parallel will be preferred over connecting them in series because the disconnection of a winding is more likely than a short circuit.

The invention concerns generally a valve actuating device for an internal combustion engine comprising a member connected to the valve and displaceable following a course whereby, at one end of this course, the valve is in the closed position, and at the other end of the course this valve is in the open position, the movement being performed by means of a first and a second electromagnet and spring means such that the member is in proximity to the second electromagnet for the open position of the valve, the device being such that the first electromagnet is of the polarized type with a permanent magnet enabling the member to be held in the position corresponding to the closing of the valve in the absence of current in the winding of this first electromagnet, and the second electromagnet is such that the open position is maintained by a greater than zero current in the winding of the second electromagnet.

This device is characterized in that it comprises a means for detecting the operation of the coils of the electromagnets and a safety means so that, in case of breakdown of one of the windings, there will be applied to the winding of the non-failing electromagnet a current permitting the placement of the valve in the closed position.

In one embodiment, the safety means comprises a means so that, in case of breakdown of the winding of the first electromagnet, a current will be applied to the winding of the second electromagnet such that the member is pushed back toward the first electromagnet.

Preferentially, to limit the current consumption, the second electromagnet is of the polarized type, the permanent magnet of this second electromagnet providing a magnetic field of a value insufficient for opposing the inverse effect of the spring means when the member is in the valve-open position.

In a variant, the second electromagnet is not provided with a permanent magnet.

In one embodiment, the device comprises a means for changing the valve from the closed position to the open position, which comprises a means for applying to the winding of the first electromagnet a demagnetizing pulse opposing the effect of the permanent magnet of this first electromagnet.

In one embodiment the winding of the first electromagnet and the winding of the second electromagnet are in parallel.

The invention also relates to a motor comprising a device as defined above.

BRIEF DESCRIPTION OF THE DRAWINGS

Other features and advantages of the invention will appear with the description of some of its embodiment which will be given with reference to the annexed drawings wherein.

DETAILED DESCRIPTION OF THE EMBODIMENTS

Figure 1:
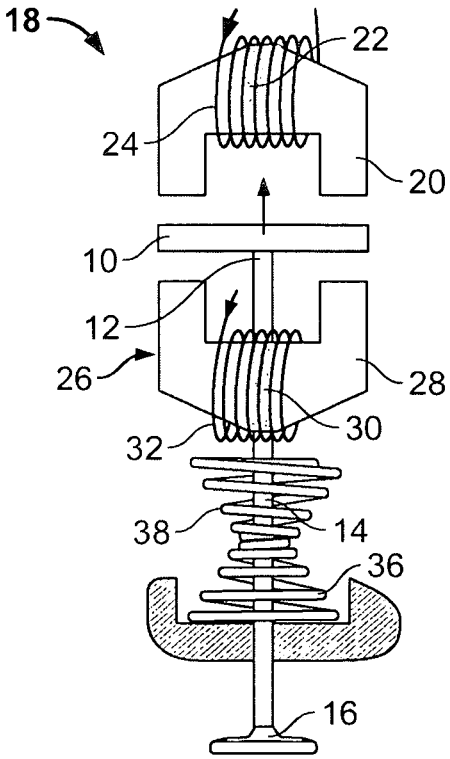
FIG. 1 is a diagram of a valve actuating device in a first embodiment.

In FIG. 1 there is shown an embodiment of an actuator according to the invention, in which, on the one hand, a closing electromagnet of the polarized type is shown, with a magnet enabling the valve to be locked in the closed position in the absence of current in the corresponding winding of the electromagnet, and on the other hand an opening electromagnet, also of the polarized type, but the magnet does not of itself permit holding the valve in the open position.

Thus, in FIG. 1 there is shown a magnetic pallet or plate 10 integral with a stem 14 of a valve 16.

The closing electromagnet 18 comprises a magnetic circuit 20, a permanent magnet 22 and a controlling winding 24.

The opening electromagnet 26 comprises a magnetic circuit 28, a permanent magnet 30 and a controlling winding 32.

A spring 36 surrounds the valve stem 14. It is arranged so that it is compressed when the valve 16 is in the open position (toward the bottom in FIG. 1) and relaxed in the case where the valve 16 is in the closing position (toward the top in the representation of FIG. 1).

Likewise, a spring 38 surrounds the stem 12 and is arranged so that it is compressed when that valve is in the closed position and relaxed when the valve is in the open position.

The magnet 30 has been shown with a thickness less than that of the magnet 22 of the electromagnet 18 so as to show that the attractive effect which it produces is appreciably less than that of this magnet 22.

When the actuator represented in FIG. 1 operates normally (without failure), the plate 10 is attracted toward the magnetic circuit 20 due to the powering of the winding 24 and to the effect of the permanent magnet 22. The current in winding 24 is zero when the valve is in the closed position since the magnet 22 is sufficient to hold the plate 10 against the magnetic circuit 20. In this position the spring 36 is relaxed and spring 38 is compressed.

To shift from the closed position to the open position a demagnetizing current is applied to the winding 24 which opposes the effect of the permanent magnet 22, that is to say, a current of a sense contrary to that which is used for attracting the plate 10 toward the circuit 20.

Due to the effect of this demagnetizing current and to the effect of spring 38, the plate 10 is directed toward the circuit 28. Then the winding 32 is powered to attract the plate 10 toward the circuit 28. The permanent magnet 30 has characteristics insufficient for applying the plate 10 to the circuit 28 in case of zero current in the coil 32. However, the presence of this magnet 30 permits minimizing the current circulating in this winding 32.

In case of breakdown of the winding 32, detected for example by a permanent absence of current in this winding, the plate 10 is pushed to an intermediate position between the two circuits 20 and 28 by the effect of the spring 38. The valve can then be closed so as to keep the motor in safety position, by temporarily feeding winding 24 so that the plate 10 will remain applied against the circuit 20.

In case of breakdown of winding 24—this breakdown being likewise able to be detected by the absence of current in spite of a power delivery command, a current is applied to the winding 32 which permits the plate to be pushed toward circuit 20 and therefore to bring about the closing of valve 16. The valve 16 can then remain in this position by the effect of the permanent magnet 22.

Thus, regardless of the broken-down winding, the valve can be held in the closed position.

Figure 3A:
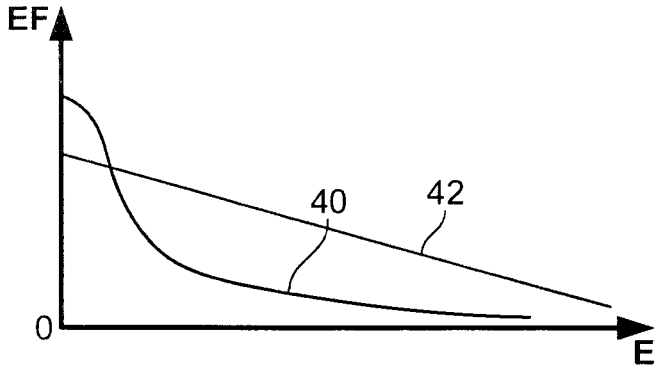
FIGS. 3*a* and 3*b* are diagrams showing the operation of the actuator represented in FIGS. 1 and 2.

FIG. 3*a* is a diagram in which forces (EF) have been represented on the ordinates and the gaps (E) on the abscissae, gap zero corresponding to the plate 10 applied against the magnetic circuit 20.

Curve 40 represents the force applied by the electromagnet 18 when the intensity of the electric current in coil 24 is zero, i.e., the force applied mainly by the magnet 22. Curve 42 represents the forces of the springs which are applied in the contrary direction to the plate 10. It is thus seen that, with a small gap, the force of magnet 22 exceeds that of the springs, thus making it possible to keep the plate 10 against the magnetic circuit 20.

Figure 3B:
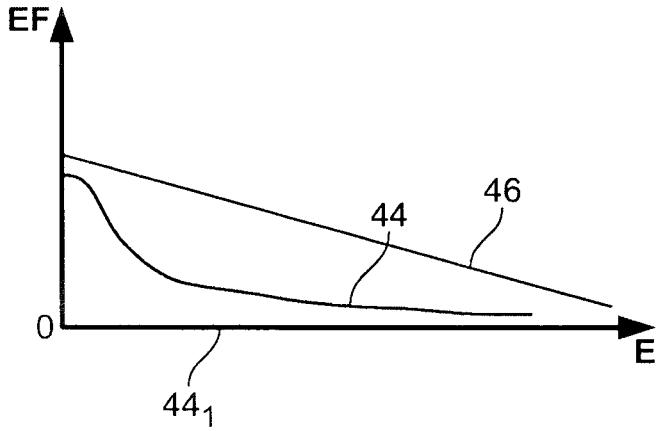

The diagram in FIG. 3*b* corresponds to the operation of the electromagnet 26 when the intensity of the current in winding 32 is zero. So on the abscissae the zero gap corresponds to the position in which the plate 10 is applied against the magnetic circuit 28. The curve 44 represents the force applied by the magnet 30, and curve 46 represents the antagonistic force of the springs. Thus it is seen that the force 46 of the springs is always greater than the force 44 applied by the permanent magnet 30 in the case of zero current in the winding 32.

Figure 2:
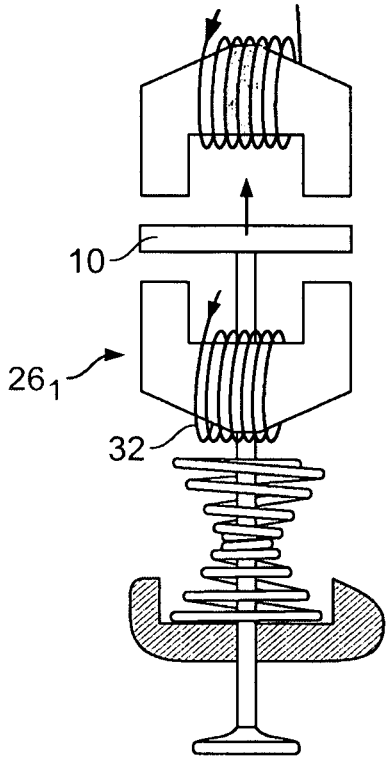
FIG. 2 is a diagram similar to that of FIG. 1, but for a variant.

The embodiment shown in FIG. 2 differs from that represented in FIG. 1 only in that the electromagnet 26 has no permanent magnet.

Operation in this case is similar to the one described above for FIG. 1. The only difference, represented in FIG. 3*b*, is that the curve 44, if the current in winding 32 is zero, coincides with the axis of the abscissae, i.e., that the electromagnet exercises no force on the plate 10.

What is claimed is:

1. Apparatus for operating a valve of an internal combustion engine, comprising:

a first polarized type electromagnet comprising a permanent magnet and a winding;

a second electromagnet comprising a winding;

a spring; and a member connected to said valve, and displaceable by said first electromagnet, said second electromagnet and said spring to shift said valve to either an open position or a close position, and wherein said member is at a first position near said first electromagnet when said valve is in said closed position and held at said first position in the absence of a current in said winding of said first electromagnet, and at a second position near said second electromagnet when said valve is in said open position and held at said second position for a non-zero current in said winding of said second electromagnet;

a detection means for detecting a failure in said winding of said first electromagnet or said winding of said second electromagnet; and a safety means for applying a current to said winding of a non-failing electromagnet permitting said valve to be placed in said closed position when said detection means detects said failure.

2. Apparatus of claim 1, wherein said second electromagnet is a polarized type electromagnet comprising a permanent magnet having a magnetic field of a value insufficient for opposing inverse effect of said spring when said member is at said second position corresponding to said open position of said valve, such that said-non zero current in said winding of said second electromagnet, is necessary to shift and maintain said member at said second position.

3. Apparatus of claim 1, wherein said safety means applies said current permitting said valve to be in said closed position to said winding of said second electromagnet to shift said member towards said first position when said detection means detects a failure in said winding of said first electromagnet.

4. Apparatus of claim 1, further comprising a shifting device for shifting said valve from said closed position to said open position when a demagnetizing current is applied to said winding of said first electromagnet oppose the effect of said permanent magnet of said first electromagnet.

5. Apparatus of claim 4, wherein said demagnetizing current comprises one demagnetizing pulse.

6. Apparatus of claim 1, wherein said permanent magnet or said first electromagnet is operable to hold said member at said first position in the absence of the current in said winding of said first electromagnet.

7. A motor comprising said apparatus of claim 1.

8. Apparatus for operating a valve of an internal combustion engine, comprising:

a first polarized type electromagnet comprising a permanent magnet and a winding;

a second electromagnet comprising a winding;

a spring; and a member connected to said valve, and displaceable by said first electromagnet, said second electromagnet and said spring to shift said valve to either an open position or a close position, and wherein said member is at a first position near said first electromagnet when said valve is in said closed position and held at said first position when said winding of said first electromagnet has zero current, and at a second position near said second electromagnet when said valve is in said open position and held at said second position for a non-zero current in said winding of said second electromagnet;

a detection means for detecting a failure in said winding of said first electromagnet or said winding of said second electromagnet; and a safety means for applying a current to said winding of a non-failing electromagnet permitting said valve to be placed in said closed position when said detection means detects said failure.

9. Apparatus of claim 1, wherein said winding of said first electromagnet and said winding of said second electromagnet are connected in parallel.

* * * * *